US007509783B1

(12) United States Patent
Matousek

(10) Patent No.: US 7,509,783 B1
(45) Date of Patent: Mar. 31, 2009

(54) REINFORCING ROD

(76) Inventor: Thomas Matousek, 4129 S. Arthur Ave., Brookfield, IL (US) 60513

( * ) Notice: Subject to any disclaimer, the term of this patent is extended or adjusted under 35 U.S.C. 154(b) by 381 days.

(21) Appl. No.: 11/171,048

(22) Filed: Jul. 1, 2005

(51) Int. Cl.
*E04C 2/00* (2006.01)

(52) U.S. Cl. ..... 52/851; 52/852; 404/45; 404/70; 404/134

(58) Field of Classification Search ..... 52/740.1, 52/738.1, 740.2–740.6, 414, 432, 396.02, 52/514; 404/45, 70, 134
See application file for complete search history.

(56) References Cited

U.S. PATENT DOCUMENTS

| | | | | |
|---|---|---|---|---|
| 2,080,124 | A * | 5/1937 | Friberg | 52/396.02 |
| 2,405,274 | A * | 8/1946 | Stites | 428/592 |
| 3,488,907 | A * | 1/1970 | Aberg | 52/309.1 |
| D262,093 | S | 12/1981 | Bush et al. | |
| 4,929,294 | A | 5/1990 | Blome | |
| 5,469,679 | A | 11/1995 | Burkard et al. | |
| 5,681,126 | A * | 10/1997 | Lin | 403/313 |
| 5,867,960 | A | 2/1999 | Andraet et al. | |
| 6,092,960 | A | 7/2000 | McCallion | |
| 6,185,886 | B1 * | 2/2001 | Gruen et al. | 52/223.13 |
| 6,265,065 | B1 * | 7/2001 | McCallion | 428/375 |
| 6,389,774 | B1 | 5/2002 | Carpenter | |
| 2004/0031228 | A1 * | 2/2004 | Hardy et al. | 52/687 |

FOREIGN PATENT DOCUMENTS

GB 2210135 A * 6/1989

* cited by examiner

*Primary Examiner*—Jeanette E Chapman
*Assistant Examiner*—Daniel Kenny

(57) ABSTRACT

A reinforcing rod includes a rectilinear and elongated shaft that has a centrally disposed longitudinal axis and includes a monolithically formed spine extending along an entire length of the shaft and parallel to the axis. The spine includes monolithically formed coextensive rings equidistantly spaced and juxtaposed along a length of the shaft. The spine bifurcates the rings. The rings form a generally spiral pattern about the shaft. The shaft is formed from steel. A mechanism is included for providing a smooth surface of the shaft.

5 Claims, 4 Drawing Sheets

REINFORCING ROD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to rods and, more particularly, to a reinforcing rod for use in continuously reinforced concrete pavement.

2. Prior Art

The present invention pertains to improvements in the field of pavement construction such as those designed for highway transportation. It is well known that concrete has a comparatively high compressive strength, a comparatively low tensile and shear strength, and that concrete expands and contracts due to changes in temperature. Because highways can experience large temperature changes over the course of a calendar year, accommodations must be made for the resulting changes in the concrete.

For example, winter temperatures may cause the concrete to experience subzero temperatures, while the same concrete may be exposed to temperatures of over 100 degrees Fahrenheit in the summer. The thermal expansion and contraction of the concrete under these conditions can prove destructive, leading to cracking and surface discontinuities if the proper precautions and measures are not taken. In addition concrete will crack naturally, as a result of the curing process, which takes place from the time of placement of the fluid concrete material, until full design strength is achieved. This occurs usually within one month after initial placement of the concrete.

Engineers have found that a series of concrete blocks or slabs positioned with a gap to relieve the stresses in the blocks at the maximum expansion anticipated provides the best solution to these problems. Joints or spacing in between the blocks are necessary to accommodate thermal expansion and contraction of the concrete due to changes in the environmental temperatures, and strategic placement of the joints assist engineers in controlling the direction of the expansion and predicting the location where the concrete will crack as a result of the curing process.

The use of discrete blocks, however, is not without its own problems. Uneven expansion or contraction of the individual blocks can result in discontinuities in the highway which, in turn, can lead to unsatisfactory road conditions as well as stress and fatigue in the individual blocks. Blocks can shift up to create unsafe road conditions and reduce the life of the road Accordingly, a need remains for a reinforcing rod in order to overcome the above-noted shortcomings. The present invention satisfies such a need by providing a reinforcing rod that is easy to install and improves the durability of the concrete it is employed with. By aligning the non-deformed sections of a series of parallel rods of this nature, the hairline cracks that develop in the subsequently applied concrete will form transversely and with uniform spacing therebetween. This helps to extend the overall life expectancy of the roadway in question.

BRIEF SUMMARY OF THE INVENTION

In view of the foregoing background, it is therefore an object of the present invention to provide a reinforcing rod. These and other objects, features, and advantages of the invention are provided by a reinforcing rod for use in continuously reinforced concrete pavement.

The reinforcing rod includes a rectilinear and elongated shaft that has a centrally disposed longitudinal axis and includes a monolithically formed spine extending along an entire length of the shaft and parallel to the axis. Such a spine includes a plurality of monolithically formed coextensive rings equidistantly spaced and juxtaposed along a length of the shaft. The rings form a generally spiral pattern about the shaft. Such a shaft is formed from steel. An outer surface of the shaft may include an epoxy coating. Such a shaft has a diameter less than a diameter of the sleeve.

A mechanism is included for limiting sporadic and undesirable cracks from occurring in the concrete pavement over extended time intervals. Such a crack limiting mechanism defines at least one smooth exterior surface concentrically spaced from the axis and equidistantly spaced along the entire length of the shaft. The crack limiting mechanism preferably includes a plurality of removable and bifurcated sleeves selectively positional along the length of the shaft. Such sleeves include a pair of coextensive sections. Each section has a smooth outer surface and first and second edges monolithically formed therewith respectively. The sections preferably have a generally concave shape. Each section further includes a plurality of equidistantly spaced protrusions formed along an inner surface thereof and extending inwardly therefrom. Such protrusions preferably have a rectangular shape.

The pair of first edges are directly and pivotally connected such that the pair of second edges are directly mateable when axially pivoted one hundred and eighty degrees about the shaft. The protrusions effectively cooperate with the rings such that the rings are positioned generally medially of the corresponding protrusions when the pair of second edges are axially pivoted about the shaft. The smooth exterior surfaces of the sections advantageously evenly distribute the external forces acting on the concrete pavement and thereby reduce the likelihood of premature cracking and deterioration during extended time intervals.

In an alternate embodiment, the crack limiting mechanism may include at least one section that has a smooth exterior surface extending along a partial length and circumference of the shaft. Such a smooth exterior surface extends about a circumference of the shaft for advantageously and effectively reducing the existence of sporadic and uncontrolled cracks in concrete pavement.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
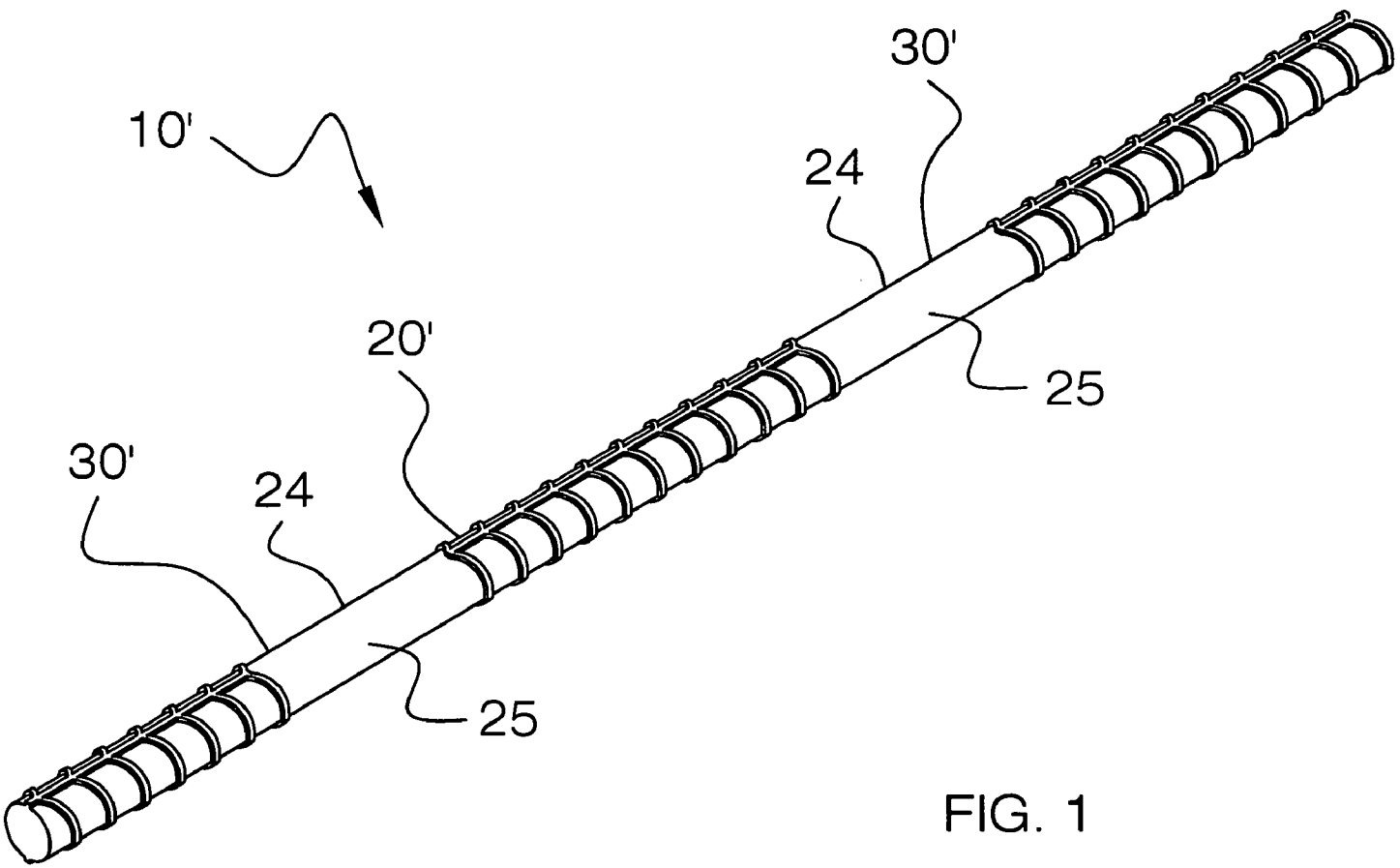
FIG. 1 is a perspective view showing an alternate embodiment of a reinforcing rod, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime numbers refer to alternate embodiments of such elements.

The apparatus of this invention is referred to generally in FIGS. 1-5 by the reference numeral 10 and is intended to provide a reinforcing rod. It should be understood that the apparatus 10 may be used to reinforce concrete in many different types of situations and should not be limited in use to only concrete that is used for highway construction.

Referring initially to FIG. 1, the apparatus 10 includes a rectilinear and elongated shaft 20 that has a centrally disposed longitudinal axis and includes a monolithically formed spine 21 extending along an entire length of the shaft 20 and parallel to the axis. Of course, the shaft 20 may be produced in a variety of different lengths, widths and shapes, as is obvious to a person of ordinary skill in the art. Such a spine 20 includes a plurality of monolithically formed coextensive rings 22 equidistantly spaced and juxtaposed along a length of the shaft 20. The rings 22 form a generally spiral pattern about the shaft 20. Such a shaft 20 is formed from steel. An outer surface 23 of the shaft 20 includes an epoxy coating, which is essential and advantageous for protecting the shaft 20 from rusting when exposed to moisture in the concrete mix. This feature thus ensures that the apparatus 10 maintains its structural integrity. Such a shaft 20 has a diameter less than a diameter of the sleeve 31 (described herein below), which is vital for allowing the sleeve 31 to be completely biased about the shaft 20.

Figure 2:
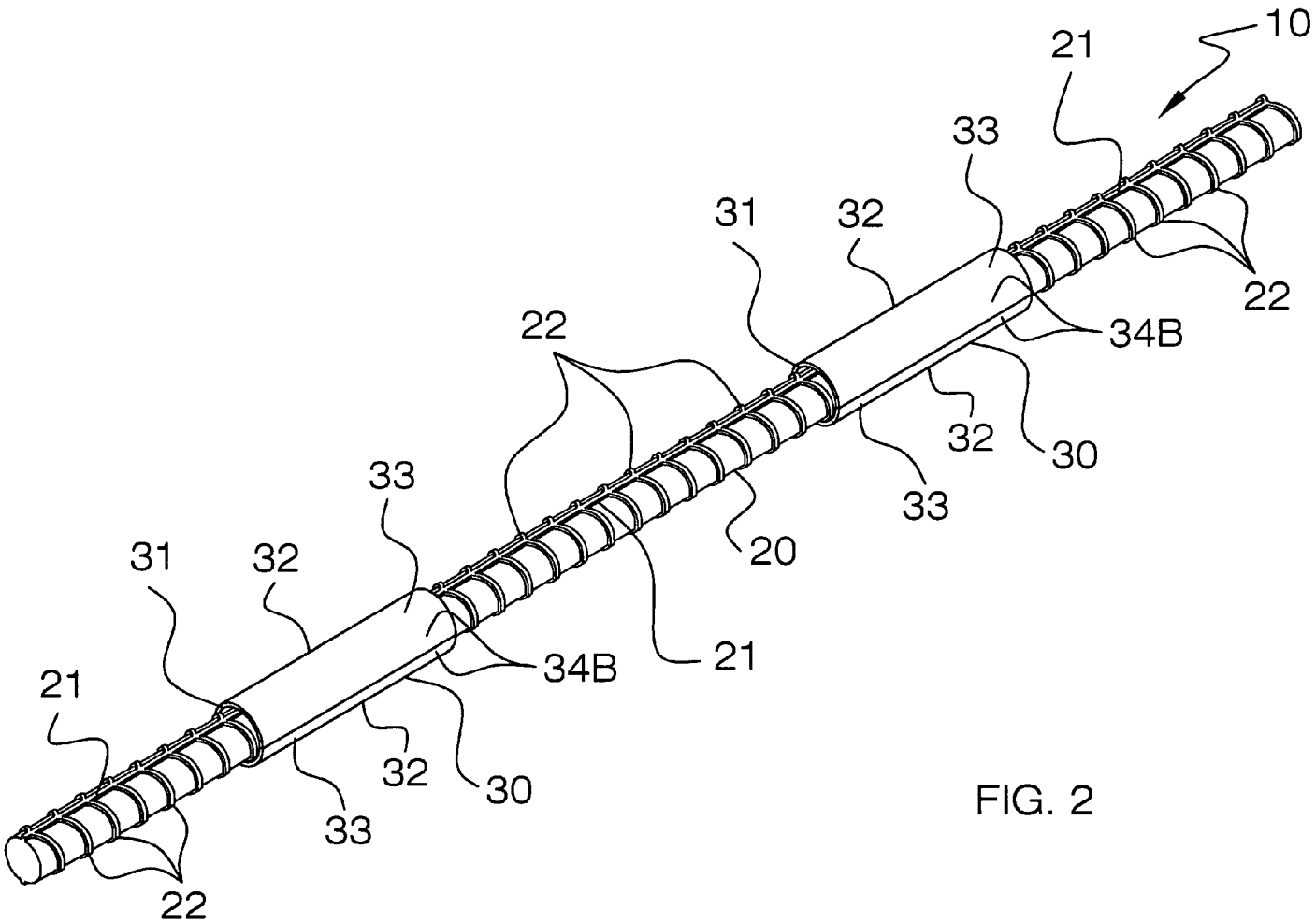
FIG. 2 is a perspective view showing a preferred embodiment of a reinforcing rod, in accordance with the present invention.
Figure 4:
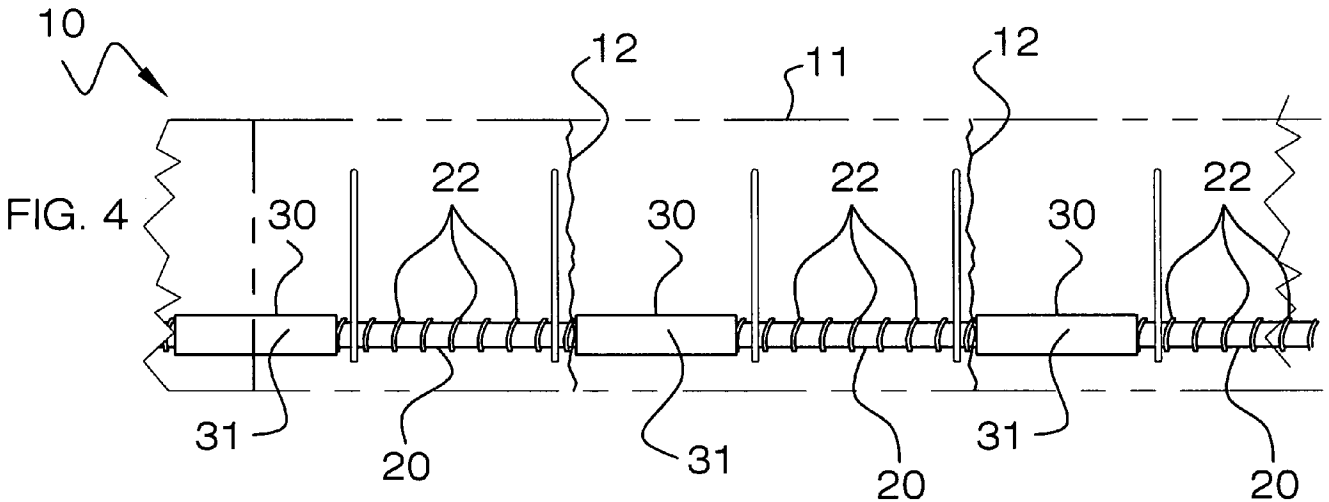
FIG. 4 is a side-elevational view of the rod shown in FIG. 2, showing the rod with sleeves attached thereto and positioned in a concrete slab.
Figure 5:
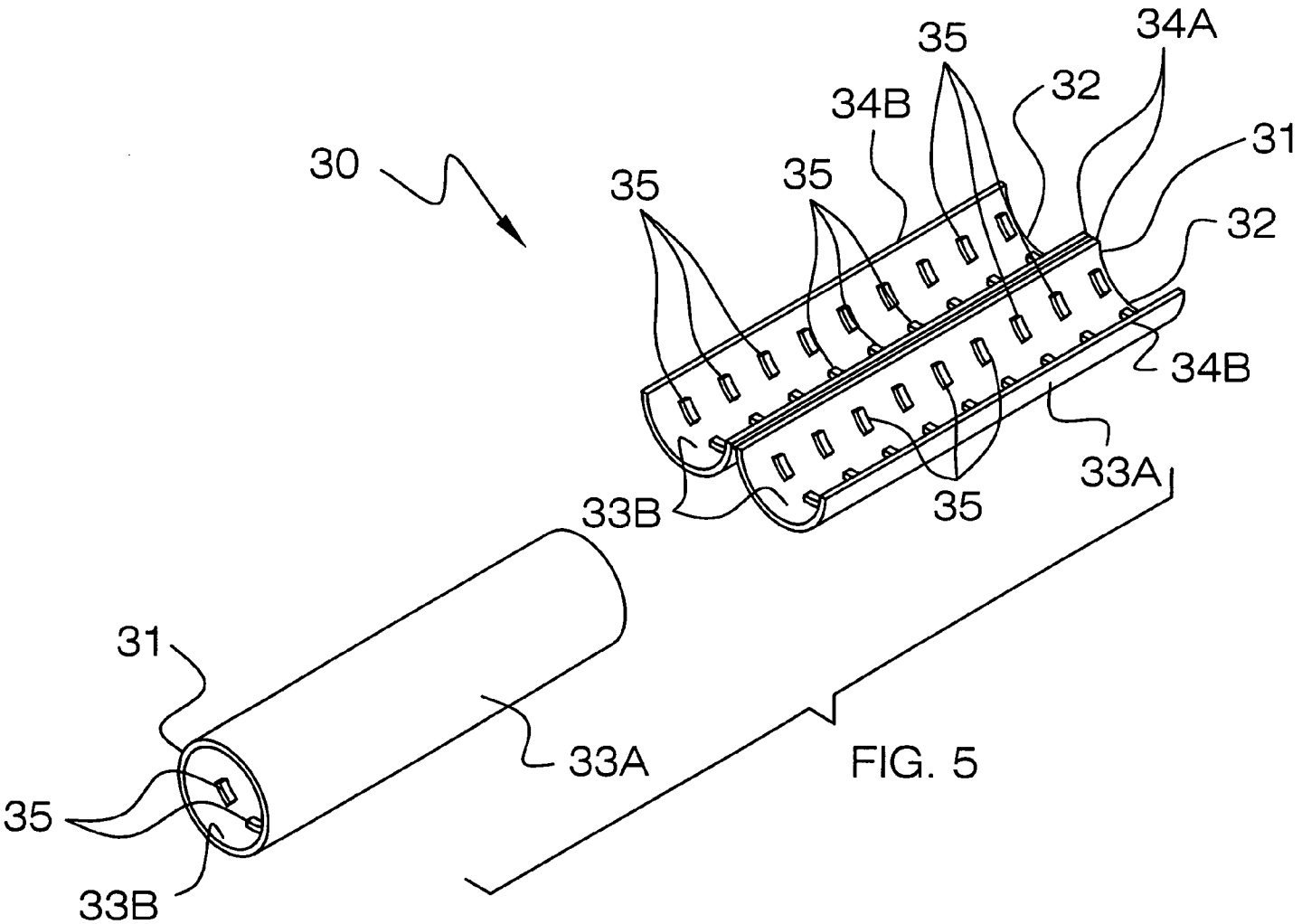
FIG. 5 is a perspective view of the sleeve shown in FIG. 2, showing the sleeve at a closed and an open state.

Referring to FIGS. 2, 4 and 5, a mechanism 30 is included for limiting sporadic and undesirable cracks from occurring in the concrete pavement over extended time intervals. Such a mechanism 30 defines at least one smooth exterior surface concentrically spaced from the axis and equidistantly spaced along the entire length of the shaft 20.

In a preferred embodiment 10, the crack limiting mechanism 30 includes a plurality of removable and bifurcated sleeves 31 selectively positional along the length of the shaft 20. Of course, the sleeves 31 may be produced in a variety of different lengths and sizes so as to accommodate shafts 20 having various lengths and widths, as is obvious to a person of ordinary skill in the art. Such sleeves 31 include a pair of coextensive sections 32. Each section 32 has a smooth exterior surface 33A, first 34A and second 34B edges monolithically formed therewith respectively and a generally concave shape.

Each section 32 further includes a plurality of equidistantly spaced protrusions 35 formed along an inner surface 33B thereof and extending inwardly therefrom. Such protrusions 35 have a rectangular shape. Of course, the protrusions 35 may be alternately sized and shaped, as is obvious to a person of ordinary skill in the art.

Again referring to FIGS. 2, 4 and 5, the pair of first edges 34A are directly and pivotally connected, with no intervening elements, which is crucial such that the pair of second edges 34B are directly mateable, with no intervening elements, when axially pivoted one hundred and eighty degrees about the shaft 20. This feature advantageously ensures that a uniform smooth surface is formed about the entire shaft 20, which is critical for the proper functioning of the apparatus 10. The protrusions 35 effectively cooperate with the rings 22 such that the rings 22 are positioned generally medially of the corresponding protrusions 35 when the pair of second edges 34B are axially pivoted about the shaft 20.

The smooth outer surfaces 33A of the sections 32 advantageously evenly distribute the external forces acting on the concrete pavement 11 and thereby reduce the likelihood of premature cracking and deterioration during extended time intervals. Such smooth outer surfaces 33A further ensure that any cracks 12 that do form as the concrete matures and sets are formed in a linear and uniform fashion, instead of randomly spreading across the concrete pavement 11. This advantageously prevents large pieces of concrete from becoming unstable and prone to breaking loose from the main portion of concrete pavement 11.

Figure 3:
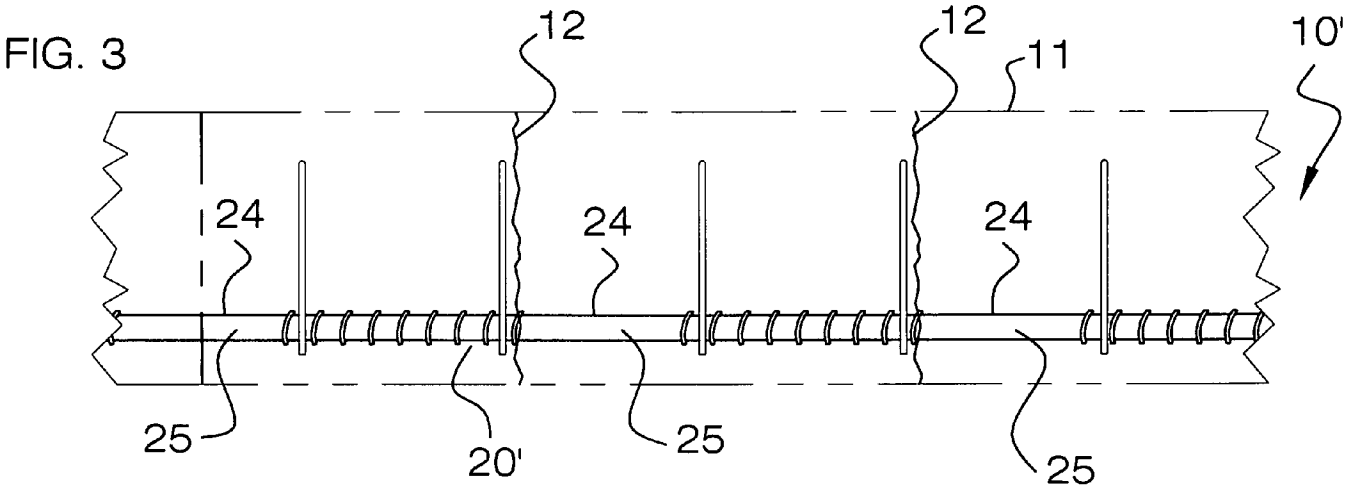
FIG. 3 is a side-elevational view of the rod shown in FIG. 1, showing the rod positioned in a concrete slab.

Referring to FIGS. 1 and 3, in an alternate embodiment 10', the crack limiting mechanism 30' includes at least one section 24 that has a smooth exterior surface 25 extending along a partial length and a circumference of the shaft 20' for reducing the existence of sporadic and uncontrolled cracks in concrete pavement. At least one section 24 is monolithically formed with the shaft 20'. Of course, the shaft 20' may be produced with more than one section 24 and the section 24 may be produced in various lengths, as is obvious to a person of ordinary skill in the art. Such a smooth exterior surface 25 extends about a circumference of the shaft 20' for advantageously and effectively allowing for the formation of uniform and linear cracks 12 in concrete pavement 11, as is best shown in FIG. 3.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A reinforcing rod for use in continuously reinforced concrete pavement, said reinforcing rod comprising:

a rectilinear and elongated shaft having a centrally disposed longitudinal axis and including a monolithically formed spine extending along an entire length of said shaft and parallel to the axis, said spine including a plurality of monolithically formed coextensive rings equidistantly spaced and juxtaposed along a length of said shaft, said spine bifurcating said rings, said rings forming a generally spiral pattern about said shaft, said shaft being formed from steel, said shaft comprising means for limiting sporadic and undesirable cracks from occurring in the concrete pavement over extended time intervals, said crack limiting means defining at least one smooth exterior surface concentrically spaced from the axis and equidistantly spaced along the entire length of said shaft;

wherein said crack limiting means comprises a plurality of removable and bifurcated sleeves selectively positional along the length of said shaft, said sleeves comprising a pair of coextensive sections each having smooth outer surface and first and second edges monolithically formed therewith respectively, each said sections including a plurality of equidistantly spaced protrusions formed along an inner surface thereof and extending inwardly therefrom, said pair of first edges being directly and pivotally connected such that said pair of second edges are directly mateable when axially pivoted one hundred and eighty degrees about said shaft, said protrusions cooperating with said rings such that said rings are positioned generally medially of said corresponding protrusions when said pair of second edges are axially pivoted about said shaft;

wherein said smooth outer surfaces of said sections evenly distribute external forces acting on the concrete pavement and thereby reduce the likelihood of premature crack deterioration during extended time intervals;

said protrusions being grouped into first, second, third and fourth linear columns extending longitudinally along said sections wherein said first and second columns are disposed at a first one of said sections while said third and fourth columns are disposed at a second one of said sections, each of said protrusions spanning along a partial inner circumference of said first and second sections.

2. The rod of claim 1, wherein said crack limiting means comprises:

at least one section having a smooth surface extending along a partial length of said shaft, said smooth surface extending about a circumference of said shaft for reducing the existence of sporadic and uncontrolled cracks in concrete pavement, wherein said at least one section is monolithically formed with said shaft.

3. The rod of claim 1, wherein said sections have a generally concave shape.

4. The rod of claim 1, wherein an outer surface of said shaft includes an epoxy coating, said shaft having a diameter less than a diameter of said sleeve.

5. The rod of claim 1, wherein said protrusions have a rectangular shape.

* * * * *